United States Patent [19]

Su

[11] Patent Number: 4,854,334

[45] Date of Patent: Aug. 8, 1989

[54] NAIL TRIMMER

[76] Inventor: Hsiu-Kuei Su, No. 75 Chih Hsing Road, Peitou District, Taipei City, Taiwan

[21] Appl. No.: 122,932

[22] Filed: Nov. 19, 1987

[51] Int. Cl.[4] ..... A45D 29/05

[52] U.S. Cl. ..... 132/73.6; 132/76.4

[58] Field of Search ..... 132/73.6, 76.4, 76.5, 132/75.6, 75.8, 73

[56] References Cited

U.S. PATENT DOCUMENTS

| | | | |
|---|---|---|---|
| 1,743,010 | 1/1930 | Wilmot | 132/75.6 |
| 2,008,920 | 7/1935 | Moir | 132/73.6 |
| 2,056,379 | 10/1936 | Acocella | 132/73.6 |
| 3,613,696 | 10/1971 | Paule et al. | 132/76.5 |
| 4,103,694 | 8/1978 | Burian et al. | 132/73.6 |
| 4,175,573 | 11/1979 | Burian | 132/73.6 |
| 4,292,987 | 10/1981 | Alley | 132/76.4 |
| 4,408,623 | 10/1983 | Murray | 132/76.4 |
| 4,440,182 | 4/1984 | Holm | 132/75.6 |
| 4,643,207 | 2/1987 | Grahame | 132/73.6 |

FOREIGN PATENT DOCUMENTS

| | | | |
|---|---|---|---|
| 1457442 | 3/1969 | Fed. Rep. of Germany | 132/73.6 |
| 8005818 | 5/1982 | Netherlands | 132/73.6 |

*Primary Examiner*—John J. Wilson

[57] ABSTRACT

This invention relates to a nail trimmer which is adapted to operate automatically for trimming fingernails or toenails. The nail trimmer comprises a power supply means, a driving means, a switch means, a trimming means and a frame means. The power supply means, the driving means and the trimming means are mounted within the frame means in a linear relationship. The switch means is provided on the sidewall of the frame means. When the switch means is placed ON position, the trimmimg means is caused to rotate and achieve automatic trimming function as long as the trimming means is put in contact with the nail to be trimmed.

1 Claim, 2 Drawing Sheets

NAIL TRIMMER

BACKGROUND OF THE INVENTION

As well known, nails must be clipped and trimmed in order to make them look neat and tidy. In general, there would be sharp burrs left in the outer edge of a newly-clipped nail. Thus, as a common practice, a nail trimmer is used to further process the outer edge of the newly-clipped nail. A conventional nail trimmer generally includes a rough surface with small ridges. The nail trimmer is used to file away the sharp burrs by rubbing the rough surface of the trimmer against the outer edge of the newly-clipped nail.

Conventional nail trimmers are usually of file type or sandpaper type. When in use, they are continuously rubbed against the outer edge of the newly-clipped nail back and forth by manual operation until the sharp burrs in the outer edge of the newly-clipped nail are filed away and the outer edge of the nail is smoothed. Thus, to use the conventional trimmer, the user has to apply a pressure on the trimmer in order to press the trimmer against the outer edge of the nail in a proper manner while he or she moves the trimmer back and forth relatively to the nail. Therefore, conventional nail trimmers suffer from major disadvantages that they are laborsome, uncomfortable and inconvenient to use and that the finished nail can not become smooth and polished to a satisfactory extent.

SUMMARY OF THE INVENTION

This invention relates to a nail trimmer which is adapted to operate automatically for trimming fingernails or toenails. The nail trimmer comprises a power supply means, a driving means, a switch means, a trimming means and a frame means. The power supply means, the driving means and the trimming means are mounted within the frame means in a linear relationship. The switch means is provided on the sidewall of the frame means. When the switch means is placed in ON position, the trimming means is caused to rotate and achieve automatic trimming function as long as the trimming means is put in contact with the nail to be trimmed.

BRIEF DESCRIPTION OF THE DRAWINGS

Now, a preferred embodiment of the nail trimmer according to this invention will be described in detail in the following with reference to the accompanying drawings wherein.

Figure 1:
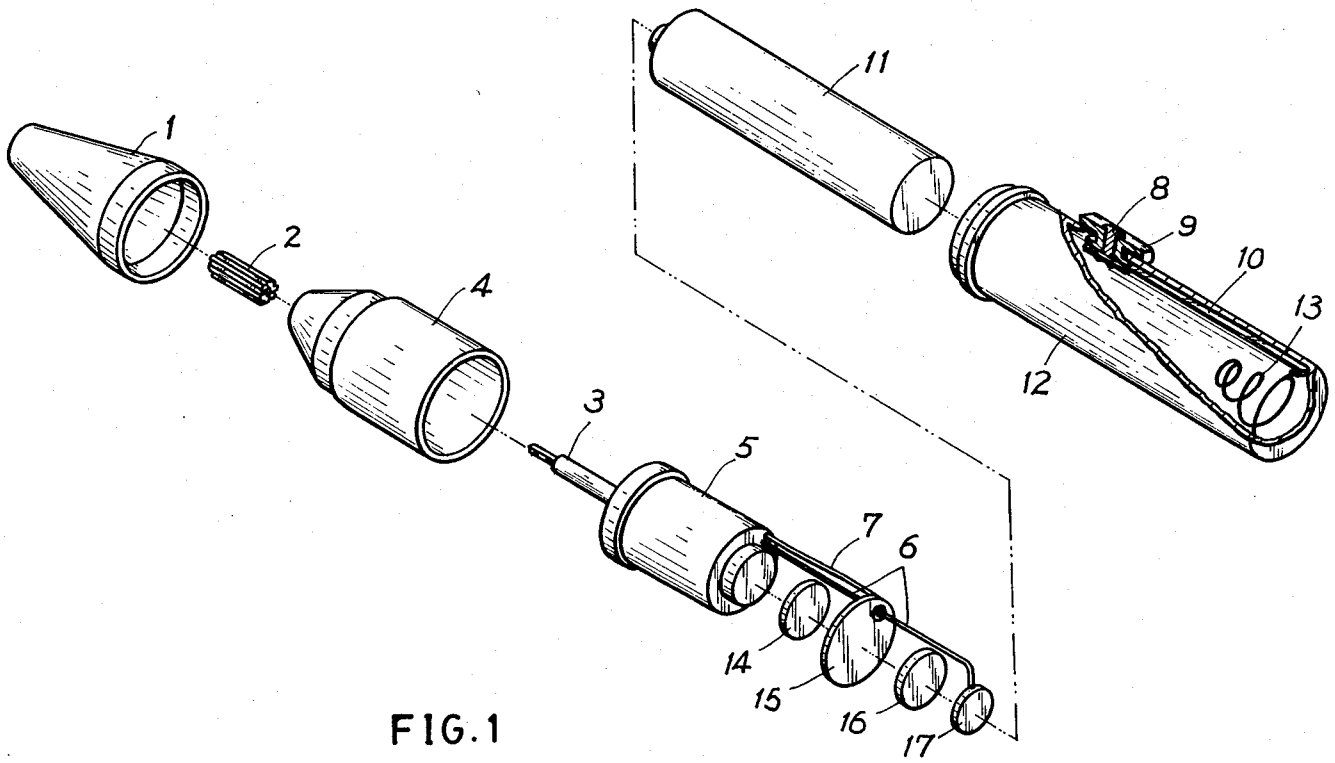
FIG. 1 is an exploded perspective view of the preferred embodiment of the nail trimmer according to this invention.

Now referring to FIG. 1, there is shown the spatial configuration and positional inter-relationship of various elements in the preferred embodiment of the novel nail trimmer according to this invention. From FIG. 1, it can be seen that the various elements in the preferred embodiment of the nail trimmer according to this invention are coupled in a substantially linear manner, and thus, the objects and functions of this invention can be achieved with the most compact structure.

Figure 2:
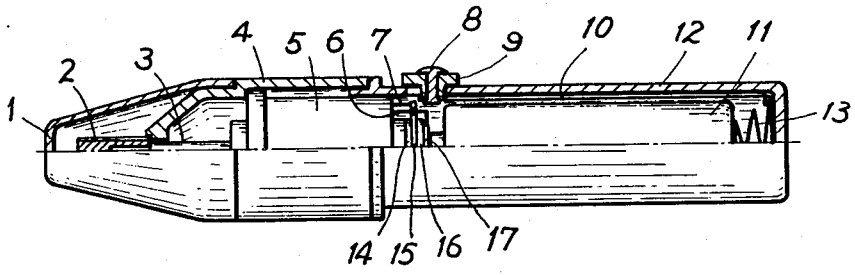
FIG. 2 is a cross-sectional view of the nail trimmer of FIG. 1 when assembled in position.

FIG. 2 illustrates that the nail trimmer of this invention includes a power supply means, a driving means, a switch means, a trimming means and a frame means. The power supply means may include a dry battery 11 and the driving means may include a conventional electric motor 5. The input of the motor 5 is connected to disc-shaped metallic contacts 15 and 17 through conductors 6 and 7 so that the metallic contacts 15 and 17 serve as the negative and positive electrodes. An insulating pad 16 is provided between these two metallic contacts and another insulating pad 14 is provided between the metallic contact 15 and the end of the motor 5 in order to provide a normal circuit for power input. The trimming means may include a trimming member 2 similar to a reamer. The trimming member 2 is securely connected to the rotary shaft 3 of the motor 5. The trimming member 2 includes a cylindrical body, of which the outer surface is formed with a plurality of grooves extending along the axial direction. These grooves are parallel to each other. The number, the width and the depth of the grooves as well as the angle defined between the sidewall of the groove and adjacent cylindrical surface can be suitably determined to achieve the nail trimming function as required. The switch means includes a sliding button 9 and a metallic strip 10 connected to the sliding button 9 by a rivet 8 at one end and connected to a spring 13 at another end in such a manner that the metallic strip 10 can be movable along with the sliding button 9 against the bias force of the spring 13.

When the nail trimmer is in use, the button 9 is pushed forward to cause the metallic strip 10 come into contact with the metallic contact 15 so that the driving means is energized to drive the trimming means into rotation. With the trimming means in rotation, the cylindrical body serves as a reamer and being adapted to trim the outer edge of the nail. When the contact pressure of the trimming means against the nail is too large, the trimming means will stop rotating by itself, and thus avoiding any damage to the nail or the finger. To stop using the nail trimmer of this invention, the button 9 is released and the metallic strip 10 is separated from the metallic contact 15 through the bias force of the spring 13 and thus the power supply is cut off. The frame means includes a housing having a lower part 12 and an upper part 4, and a cap 1. The frame means is assembled to provide a substantially cylindrical space within which the power supply means, the driving means, the switch means and the trimming means are contained.

While a preferred embodiment of this invention has been described as above, it is apparent to those skilled in the art that various modifications and changes can be made to the above-described structure without departing the spirit and scope of this invention.

What is claimed is:

1. A nail trimmer comprising:

a frame means having a housing and a cap sealing said housing;

a driving means having a motor held in a first end portion in said housing;

a power supply means for powering said driving means stored in a second end portion in said housing opposite to said first end portion of said housing;

a switch means operatively switching said power supply means for driving or stopping a rotation of said motor of said driving means; and a trimming means secured to a shaft of said motor protruding outwardly from said first end portion of said housing for trimming a nail;

said trimming means including a cylindrical body having a plurality of longitudinal grooves longitudinally formed in a cylindrical surface circumferentially disposed around a longitudinal axis of said cylindrical body, said longitudinal grooves being parallel with one another and parallel to said longitudinal axis of said cylindrical body, the improvement comprising: each said longitudinal groove defining a notch recessed from a cylindrical surface of said cylindrical body as viewed from a cross section of said cylindrical body, each notch recessed radially towards said axis from said cylindrical surface of said cylindrical body to form a configuration having each said longitudinal groove followed by a longitudinal arcuate surface which circumferentially defines the cylindrical surface of said cylindrical body of said trimming means and is convex from each neighboring longitudinal groove, said longitudinal groove followed by said longitudinal arcuate surface to be subsequently circumferentially disposed on said cylindrical body of said trimming means to have said longitudinal grooves intermittently distributed on said cylindrical surface of said trimming means, whereby an user's nail may tangentially move along each longitudinal arcuate surface of said cylindrical body to be subsequently filed against each longitudinal groove of said cylindrical body of said trimming means for smooth safer trimming of the nail.

* * * * *